United States Patent [19]

Kania

[11] Patent Number: 4,473,039

[45] Date of Patent: Sep. 25, 1984

[54] METHOD AND DEVICE FOR REDUCING INTAKE NOISES AND MECHANICAL VIBRATIONS IN SLOT-CONTROLLED 2-CYCLE INTERNAL COMBUSTION ENGINES

[76] Inventor: Norbert Kania, Im Langen Feld 18, 3014 Laatzen 1, Fed. Rep. of Germany

[21] Appl. No.: 283,296

[22] Filed: Jul. 14, 1981

[30] Foreign Application Priority Data

Jul. 18, 1980 [DE] Fed. Rep. of Germany ..... 3027219

[51] Int. Cl.[3] ..... F02B 33/04

[52] U.S. Cl. ..... 123/73 R; 123/74 R

[58] Field of Search ..... 123/73 A, 73 R, 74 A

[56] References Cited

U.S. PATENT DOCUMENTS 1,900,133 3/1933 Schaeffers ..... 123/73 A

FOREIGN PATENT DOCUMENTS 1055875 4/1959 Fed. Rep. of Germany ... 123/73 A
966017 3/1950 France ..... 123/73 A
1175652 11/1958 France ..... 123/73 A

*Primary Examiner*—Wendell E. Burns
*Attorney, Agent, or Firm*—Toren, McGeady and Stanger

[57] ABSTRACT

The invention relates to a method and an apparatus for reducing to a minimum the predominant full load noise of port-controlled, two-stroke internal combustion engines by constructing the lower suction port boundary and the lower piston boundary, so that there is a gradual port opening during the upward movement of the piston and a gradual port closing during its downward stroke.

5 Claims, 10 Drawing Figures

METHOD AND DEVICE FOR REDUCING INTAKE NOISES AND MECHANICAL VIBRATIONS IN SLOT-CONTROLLED 2-CYCLE INTERNAL COMBUSTION ENGINES

The invention relates to a port-controlled two-stroke internal combustion engine with a cylinder supplied via a scavenging air supply line and having suction and exhaust ports, the lower boundary of at least the suction port profile being substantially at right angles to the cylinder axis. In the case of such internal combustion engines known from DAS 2624249 an attempt has already been made varying the exhaust port geometry to reduce the idling noise of the engine. In addition to the usual exhaust opening additional auxiliary outlet openings are provided and these and the outlet port are positioned in such a way that they satisfy particular mathematical conditions. The sought objective can then only be achieved to a limited extent with the engine idling whilst the full load noise remains unchanged.

The problem of the invention is to obviate this deficiency and provide a slot-controlled two-stroke internal combustion engine in which the dominant full load noise is reduced to a minimum with the mechanical power unchanged.

According to the invention this problem is solved in that the noise-exciting suction pipe pressure gradients and amplitudes are reduced by a construction of the lower suction port boundary and/or the lower piston boundary so that there is gradual port opening during the upward piston stroke and a gradual closing during the downward piston stroke. The start and finish of the opening and closing processes are timewise extended by the suction port geometry, i.e. with a symmetrical control diagram the opening and closing processes are extended in time by advancing the opening time and delaying the closing time and by the suction port geometry configuration the free passage cross-section of the suction port is gradually changed as a function of the piston movement.

According to the invention the normal height of the port is reduced and the suction port cross-section is extended beyond the lower port limitation extending at right angles to the cylinder axis.

Advantageously the extension is shaped like a slot running in the longitudinal axis of the cylinder and which is widened in an approximately V-shaped manner towards the lower boundary of the suction port. However, the extension can also be formed by a plurality of slots or the like passing through the lower edges of the port. Finally it is possible to provide in the lower edge of the piston and facing the port extension a recess which supplements or improves the action of the port geometry.

Figure 1:
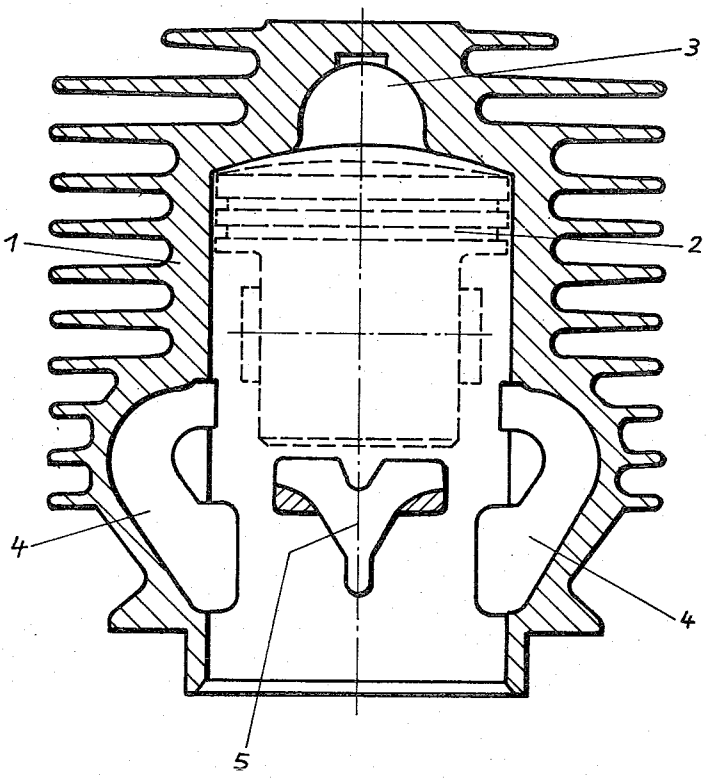

The invention is described in greater detail hereinafter relative to non-limitative embodiments and the attached drawings, wherein show:

FIG. 1: a longitudinal section through the centre of a two-stroke cylinder with a plan view of the suction port according to the invention.

Figure 2:
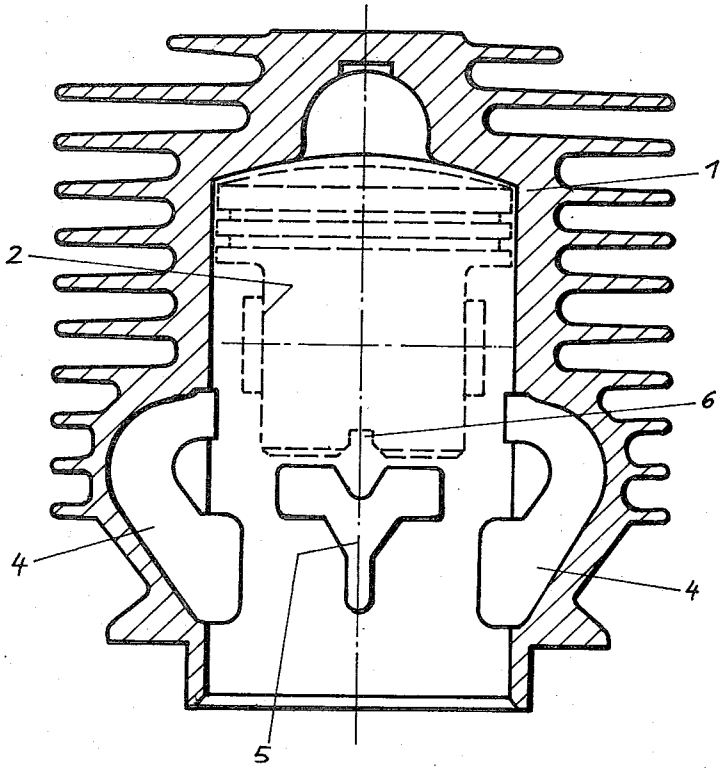

FIG. 2: a similar section to FIG. 1 using a different suction port geometry in conjunction with a special construction of the lower edge of the piston.

Figure 3:
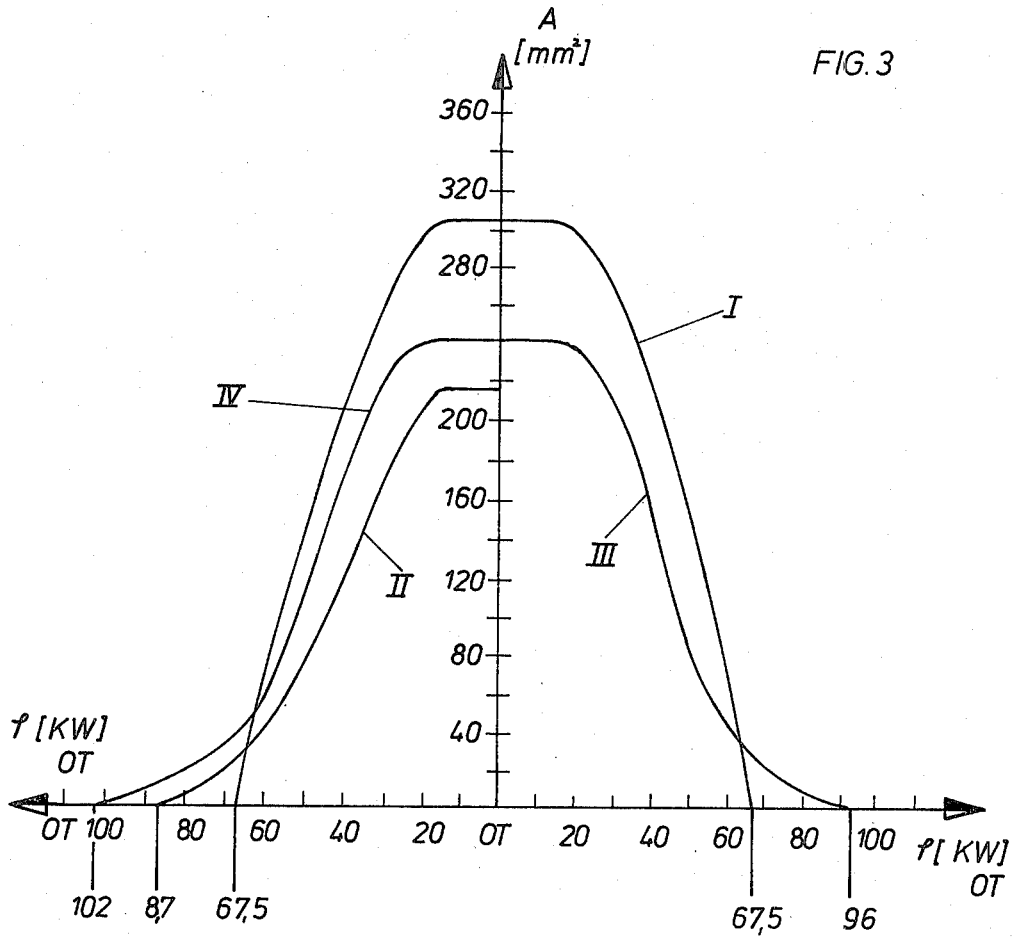

FIG. 3: control diagrams when using different inlet port geometries.

FIGS. 3*a* to 3*d*: the port geometries for the different diagrams.

Figure 4:
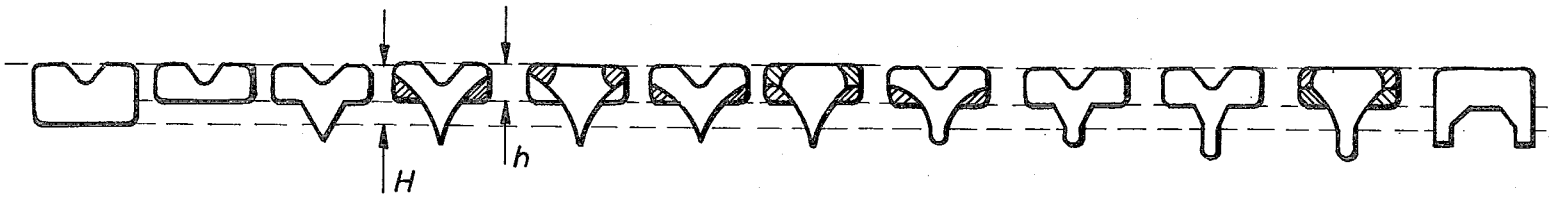

FIG. 4: a number of inlet port variants compared with the prior art.

Figure 5:
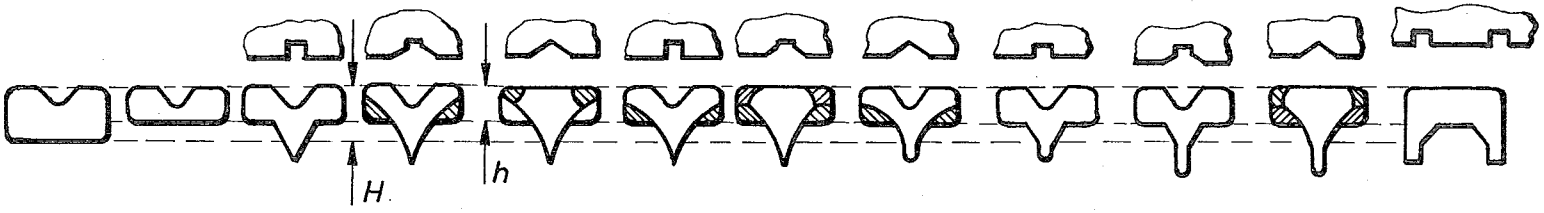

FIG. 5: a similar view to FIG. 4 in which the piston lower edges as well as the suction port are modified.

Figure 6:
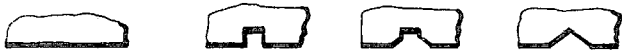

FIG. 6: views of different embodiments of the lower edge of the piston.

FIGS. 1 and 2 show in each case a longitudinal section of a cylinder 1 of a two-stroke internal combustion engine which is normally placed on the top of a crankcase. The piston 2, shown only in broken line form, works within cylinder 1 and during its upward and downward strokes sweeps over the suction port 5 and scavenging ports 4. Combustion chamber 3 is located in the cylinder head. In the embodiment of FIG. 2 the cylinder contains a suction port 5' having a different geometry, whilst there is a recess 6 facing the suction port in the lower edge of the piston.

Figure 3A:
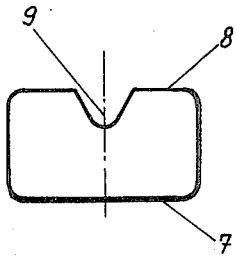

The other drawings show the most varied port geometries and for possible constructions for the lower piston edge. FIG. 3*a* shows the standard suction port configuration and construction. During the upward movement of piston 2 its lower edge frees the lower suction port edge 7 and is the upper dead centre position (OT) reaches the upper port boundary 8 or sweeps over the complete port height H. In addition, the conventional piston ring deflecting projection 9 is provided in the upper suction port boundary 8.

The control diagram belonging to this hitherto conventional port configuration shows by the course of curve I in FIG. 3 the opening and closing time which at 67.5° crank angle (KW) before or after OT. Curve I shows the port area swept by the piston stroke over time expressed in crank angle degrees. The trace of the curve provides a very considerable "filling" of the area enclosed by the curve and through the steep rise or fall enables conclusions to be drawn regarding the sudden opening or closing of the port, leading to increased noise generation.

Figure 3B:
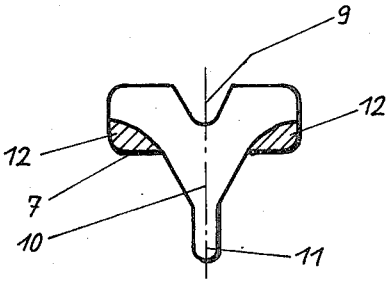
Figure 3C:
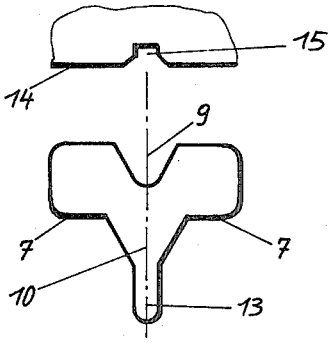
Figure 3D:
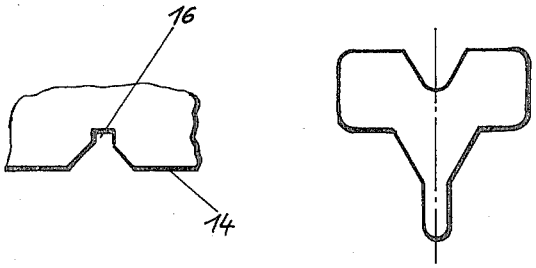

The standard port design according to FIG. 3*a* and the resulting control diagram are followed in FIGS. 3*b* to 3*d* by variants of suction ports according to the invention. Thus, e.g. in the case of the port of FIG. 3*b* its lower edge 7 is positioned at level 7'. In the underside of the port there is a V-shaped extension 10 which passes into a longitudinal slot 11. The slot corners are filled by fillings 12, so that there is a gradual smooth course of the lower slot edge on passing into the lateral boundaries.

The control diagram for this port construction is reproduced by curve II in FIG. 3. This shows that, compared with the standard port there is a earlier opening at 87° KW before OT and correspondingly a later closing. The curve rises and falls gradually. The filling is less, but the power losses which have to be taken into consideration with this reduced filling are only about 5% and are normally completely acceptable. A maximum noise reduction was obtained with the port construction of FIG. 3*b*.

In the port construction of FIG. 3*c* the inserts 12 are removed and port 13 extended. Moreover, lower edge 14 of the piston is provided with a recess 15 facing the port. A control diagram according to curve III is obtained with such a port geometry and the indicated constructon of the piston lower edge. This is characteristic of a larger filling compared with the previously described port construction and by an earlier opening and later closing, namely at 102° KW before or after OT.

Finally FIG. 3*d* shows another port construction which is much the same as that of FIG. 3*c*, except that the piston lower edge contains an enlarged V-shaped recess 16. Control diagram IV in FIG. 3 applies to this port geometry and piston lower edge construction.

FIG. 4 shows a number of port geometries according to the invention based on a standard port construction of height H. Firstly by raising the lower edge of the piston the port height H is reduced to h and only then is the extension made in the direction of the cylinder longitudinal axis from the now higher lower edge of the port.

In the proposal of FIG. 5 the inlet port constructions according to FIG. 4 are combined with differently shaped recesses in the lower edge of the piston.

Finally in certain cases there is no need for the port extension of FIG. 4 and the noise-reducing action is in particular obtained through a corresponding construction and arrangement of recesses in the lower piston edge.

I claim:

1. Port-controlled two-stroke internal combustion engine with a cylinder having suction and exhaust ports supplied by means of a scavenging air supply line, said cylinder having an axis, said cylinder having a first end and a second end each extending transversely of the cylinder axis and disposed in spaced apart relation, a cylinder head located at the first end of said cylinder, a suction port opening into said cylinder and comprising a first end closer to the first end of said cylinder, a second end more remote from the first end of said cylinder than the first end of said suction port, and a pair of sides extending transversely of and between said first and second ends, said first and second ends of said suction port extending substantially at right angles of the axis of said cylinder, said first and second ends and said sides of said suction port define an approximately rectangular section, a generally symmetrically arranged extension of said suction port extending from said second end in the direction away from said first end and forming at least in part a slot-like extension of the approximately rectangular section of said suction port with said extension disposed symmetrically relative to the axial direction of said cylinder and to the sides of said suction port.

2. Port-controlled two-stroke internal combustion engine, as set forth in claim 1, wherein said extension of said suction port comprises a V-shaped section of said extension extending from said second end of said suction port in the axial direction of said cylinder with the sides thereof converging inwardly away from said second end and an elongated slot-like section extending from the narrower end of said V-shaped section in the axial direction away from said second end of said suction port.

3. Port-controlled two-stroke internal combustion engine, as set forth in claims 1 or 2, wherein said piston has a first end and a second end each extending transversely of the axial direction of said cylinder, said second end of said piston being located more remote from the first end of said cylinder than the first end of said piston, and a recess formed in the second end of said piston inwardly toward the first end thereof, and a deflecting projection formed in the first end of said suction port extending toward the second end thereof and said projection aligned with the recess in the second end of said piston.

4. Port-controlled two-stroke internal combustion engine, as set forth in claim 3, wherein the surfaces in said piston forming said recess are V-shaped.

5. Method for operating two-stroke internal combustion engines according to claims 1 or 2 characterized in that in the case of a symmetrical controll diagram the opening and closing processes are extended timewise by advancing the opening time and delaying the closing time and as a result of the suction port geometry the free passage cross-section of the suction port is gradually changed as a function of the piston movement.

* * * * *